US005957418A

United States Patent [19]

Nelson

[11] Patent Number: 5,957,418

[45] Date of Patent: Sep. 28, 1999

[54] LEG ARRANGEMENT FOR FURNITURE

[75] Inventor: Laurence A. Nelson, Knoxville, Tenn.

[73] Assignee: P.I., Inc., Athens, Tenn.

[21] Appl. No.: 08/654,250

[22] Filed: May 28, 1996

[51] Int. Cl.[6] ..... F16M 11/16

[52] U.S. Cl. ..... 248/188; 248/188.8

[58] Field of Search ..... 403/331, 381, 403/401, 205, 231, 403; 248/188, 188.1, 188.8, 188.4, 15, 220.21, 220.22, 222.13, 222.14, 228.2, 230.2, 231.31, 223.41, 223.51, 677; 108/153, 154, 150, 156

[56] References Cited

U.S. PATENT DOCUMENTS

| | | | |
|---|---|---|---|
| 240,668 | 4/1881 | Curry | 108/156 |
| 527,145 | 10/1894 | Dempsey | 248/188 |
| 1,800,132 | 4/1931 | Brubaker | 248/188 |
| 3,134,566 | 5/1964 | Beene | 248/189 |
| 3,406,935 | 10/1968 | Mutchnik | 108/156 |
| 3,443,530 | 5/1969 | Carlson | 248/188 |
| 3,687,409 | 8/1972 | Cook | 248/151 |
| 3,960,352 | 6/1976 | Plattner | 248/188.4 |
| 4,089,614 | 5/1978 | Harley | 403/231 |
| 4,549,711 | 10/1985 | Giltnane | 248/188 |
| 5,002,247 | 3/1991 | Dispenza et al. | 248/188 |
| 5,333,964 | 8/1994 | Thomas | 403/381 |

FOREIGN PATENT DOCUMENTS

| | | | |
|---|---|---|---|
| 21404 | 3/1930 | Australia | 248/188 |
| 348821 | 2/1922 | Germany | 248/188 |

*Primary Examiner*—Leslie A. Braun
*Assistant Examiner*—Gwendolyn Baxter
*Attorney, Agent, or Firm*—Lee, Mann, Smith, McWilliams, Sweeney & Ohlson

[57] ABSTRACT

A system for attaching a furniture leg to an item of furniture. The leg includes an attachment segment having a wedge-shaped flange which is engaged in a similarly-shaped socket in the furniture. The leg is secured to the furniture by means of a screw passing through aligned apertures in the leg and the furniture, with the apertures being generally parallel to the plane of the flange.

9 Claims, 3 Drawing Sheets

LEG ARRANGEMENT FOR FURNITURE

BACKGROUND OF THE INVENTION

This invention relates to legs for furniture, and in particular to a system for attaching a furniture leg to an item of furniture which results in a secure attachment without disruption of any fabric covering applied to the furniture. While the invention is described in relation to a chair leg, it can relate to any furniture leg applied to any item of furniture or the like.

Attachment of legs to items of furniture, and particularly upholstered furniture, presents unique problems. Typically an upholstered chair or the like is upholstered first, and legs then applied thereafter. If the legs are applied by screwing the legs onto the bottom corners of the chair, disruption of the fabric of the bottom corners can occur as the chair leg engages the fabric that has been previously applied to the chair. Thus, often screw-on legs are not thoroughly tightened to avoid fabric disruption, but that can result in an unstable chair.

U.S. Pat. No. 3,134,566, which was assigned to the assignee of the present invention, is directed to a furniture leg attachment means which avoids the fabric disruption of a screw-on leg. Instead, the furniture leg is provided with a top flange, which engages a similarly-shaped attaching plate which is secured to a chair, table or other item of furniture. While a significant improvement over screw-on legs, this invention requires close tolerances between the flange at the top of the furniture leg and the attachment plate. In addition, because the flange is snugly engaged in the attachment plate, a possible detriment is the fact that the leg cannot be fully engaged in the plate without applying excessive force.

U.S. Pat. No. 4,549,711, which is assigned to the assignee of the present invention, relates to a leg system for upholstered furniture, where the legs are directly applied to a corner bracket secured to a chair or other item of furniture. While the legs do not screw on, screws or other similar fasteners must be used to secure the leg to the bracket.

SUMMARY OF THE INVENTION

The invention provides a system for attaching a furniture leg to an item of furniture. It includes an attachment segment extending from a top portion of the furniture leg, with the attachment segment having a peripheral flange lying in a plane extending at an inclination to horizontal when the item of furniture is assembled. The flange has a wedge-shaped attachment nose. A socket is associated with the item of furniture, with the socket being shaped to receive the attachment segment and having a wedge-shaped channel shaped to accommodate the wedge-shaped attachment nose of the leg. Means is provided for securing the attachment segment to the socket, with the securing means extending in a direction generally parallel to the plane of the peripheral flange of the attachment segment.

In accordance with the preferred form of the invention, the attachment segment extends from a pedestal secured to and extending above the leg. In addition to the wedge-shaped attachment nose, the flange also includes parallel legs extending from the attachment nose.

In one form of the invention, the socket is formed in a support which is shaped to be secured to the item of furniture. In another form of the invention, the support comprises part of means for assembling a portion of the item of furniture, such as a molded corner which forms part of the frame of the furniture.

In accordance with one form of the invention, the securing means comprises a first aperture through the top portion of the leg and a second aperture in the support, with the second aperture being in registration with the first aperture. A screw is threadedly secured through the first aperture into the second aperture and drawn tight, to securely seat the flange of the leg in the socket. The apertures are aligned with the wedge-shaped attachment nose for this purpose.

It is preferred that the leg be molded, such as from plastic, and that the attachment segment be an integral part of the leg. However, the leg can be made from any other material, with the attachment segment formed and then applied thereto.

BRIEF DESCRIPTION OF THE DRAWINGS

The invention is described in greater detail in the following description of examples embodying the best mode of the invention, taken in conjunction with the drawing figures, in which.

DESCRIPTION OF AN EXAMPLE EMBODYING THE BEST MODE OF THE INVENTION

Figure 1:
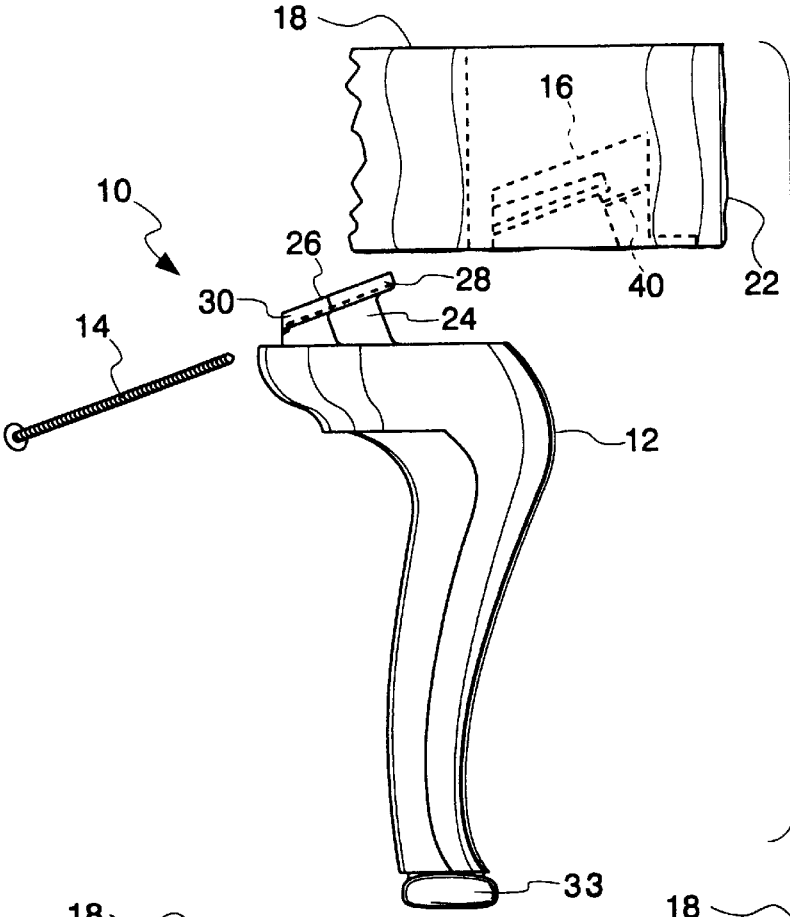
FIG. 1 is an assembly view of a system according to the invention, with the leg, fastener and item of furniture aligned just prior to assembly.

A first form of the system according to the invention, shown generally at 10, is illustrated in FIGS. 1 through 5. The system 10 is composed of a leg 12, a fastener 14, such as a screw, and a bracket 16 which is secured to the underside of a frame 18 of a chair or the like. Appropriate screws 20 can be used for this purpose.

Figure 2:
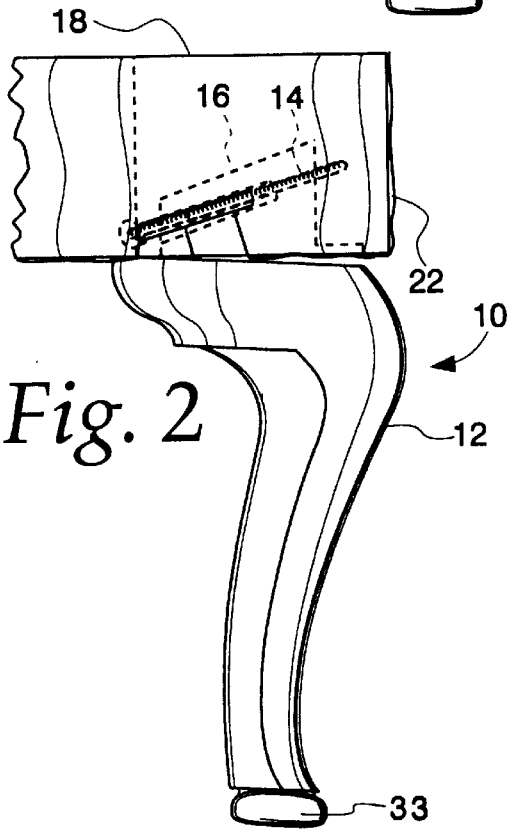
FIG. 2 is a view similar to FIG. 1, but with the leg partially seated in the socket, and with the fastener partially engaged.
Figure 3:
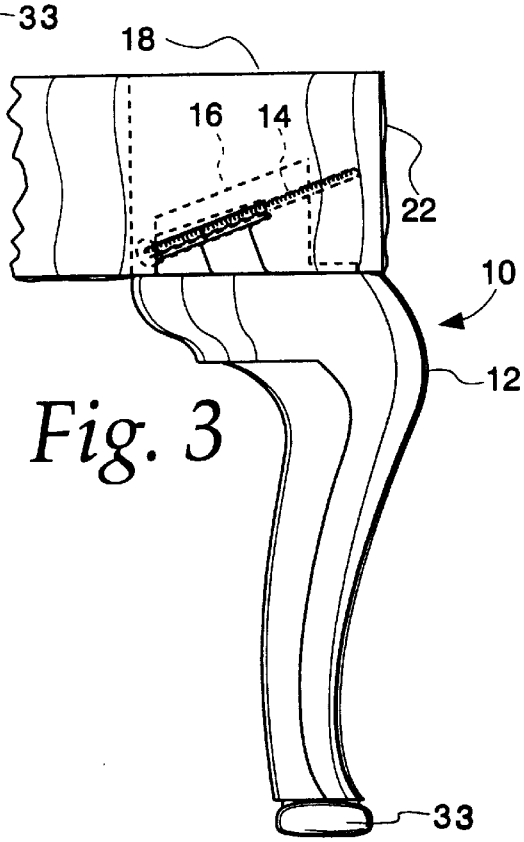
FIG. 3 is a view similar to FIG. 2, but with the leg fully seated, and with the fastener fully engaged.
Figure 4:
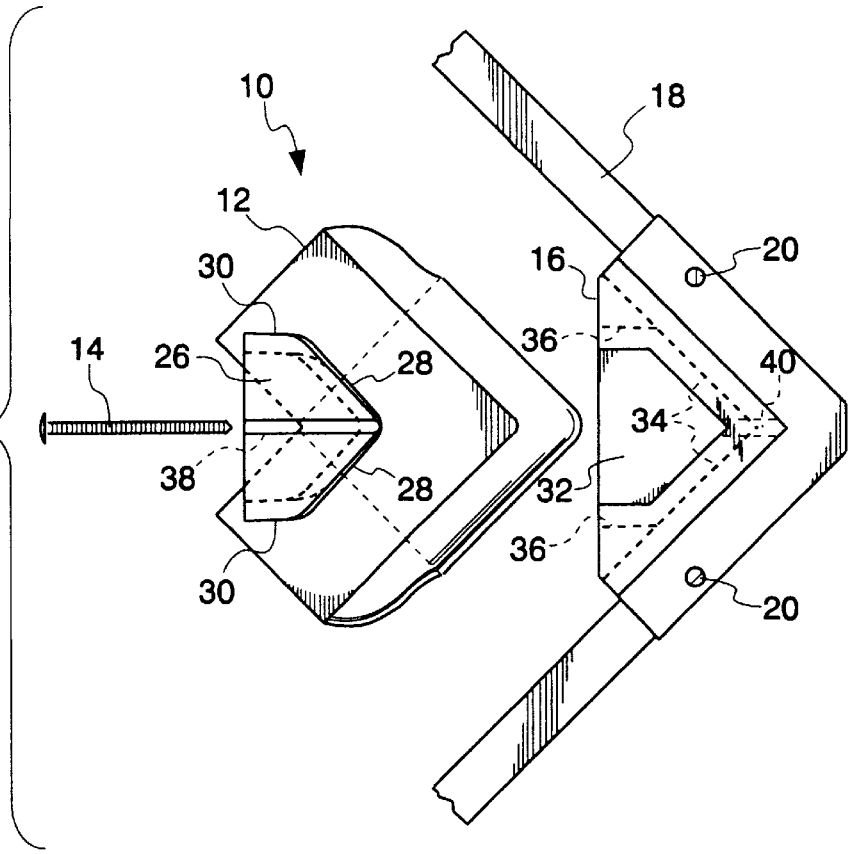
FIG. 4 is a top plan view of the system shown in FIG. 1, but without any fabric being shown on the furniture.
Figure 5:
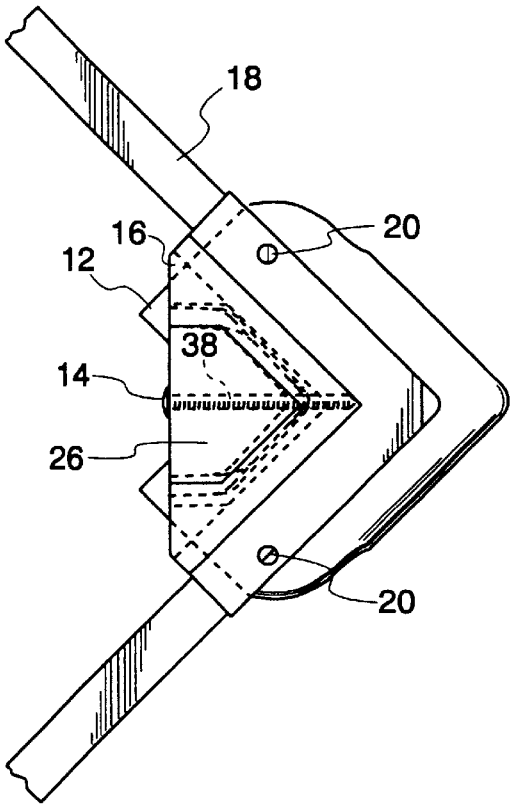
FIG. 5 is a top plan view similar to what is shown in FIG. 3, but again without fabric on the furniture.

The frame 18 is shown in FIGS. 1 through 3 as being covered by a fabric 22, and the fabric is removed in FIGS. 4 and 5 to better illustrate detail. Obviously, the frame can be covered or not with fabric, depending on the item of furniture to which the system 10 is being applied.

The leg 12 is preferably molded from plastic, although it can be made from other materials, as well. The leg 12 includes an upstanding pedestal 24 which can be molded as an integral part of the leg 12 (if molded), or can be a separate element applied to the leg 12. The pedestal 24 comprises an attachment segment and includes a top cap 26 which lies in a plane extending at an inclination to horizontal when the leg 12 is assembled to the frame 18. The top cap 26 has a peripheral flange, including a wedge-shaped attachment nose 28 and parallel legs 30 which extend rearwardly from the attachment nose 28. The leg 12 can be of any shape or configuration, and a Queen Ann style is depicted, having an adjustable bottom glide 33.

The bracket 16 includes a socket 32 (best shown in FIGS. 4 and 5) shaped to accommodate and engage the pedestal 24 and attachment nose 28 and legs 30. The socket 32 has a wedge-shaped channel 34 corresponding to the attachment nose 28 and opposite parallel channels 36 which are shaped to accommodate the legs 30.

The leg 12 includes an aperture 38 in the pedestal 24, generally parallel to the top cap 26 and therefore the plane in which the attachment nose 28 and legs 30 lie. A similar aperture 40 is formed in the bracket 16, in alignment with the aperture 38 when the leg 12 is installed so that the fastener 14 can be employed to secure the leg 12 to the frame 18.

To assemble the system 10, the bracket 16 is first appropriately secured to the frame 18, such as by the fasteners 20. The leg 12 is then aligned with the bracket 16, with the wedge-shaped attachment nose 28 being aligned with the wedge-shaped channel 34. The wedge-shaped attachment nose 28 is then engaged in the wedge-shaped channel 34, and the fastener 14 is passed through the aperture 38 into the aperture 40, resulting in the configuration shown in FIG. 2. The fastener 14 is then tightened, resulting in the fully assembled system shown in FIGS. 3 and 5.

Figure 6:
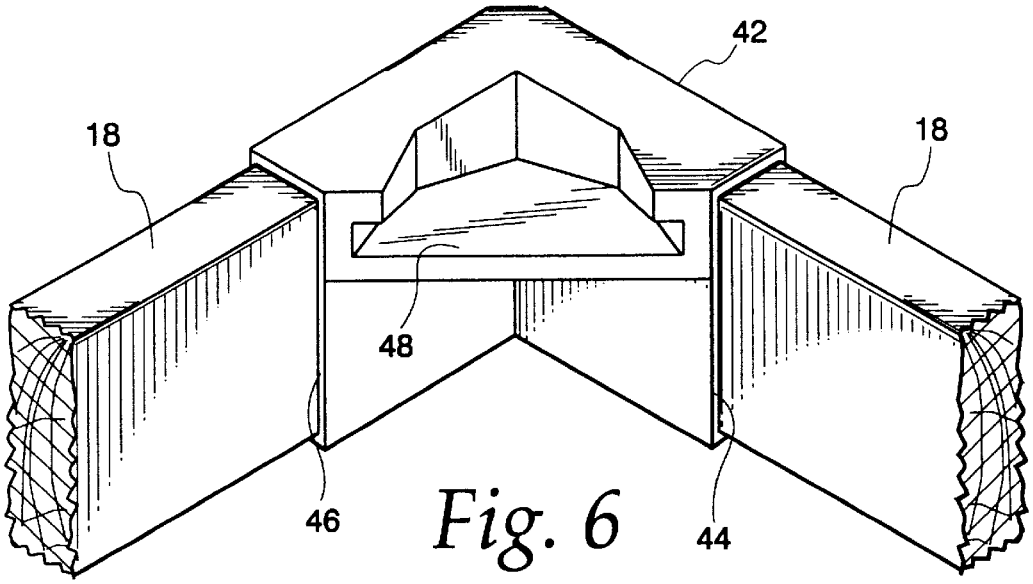
FIG. 6 is a bottom perspective view of a second embodiment of the invention.
Figure 7:
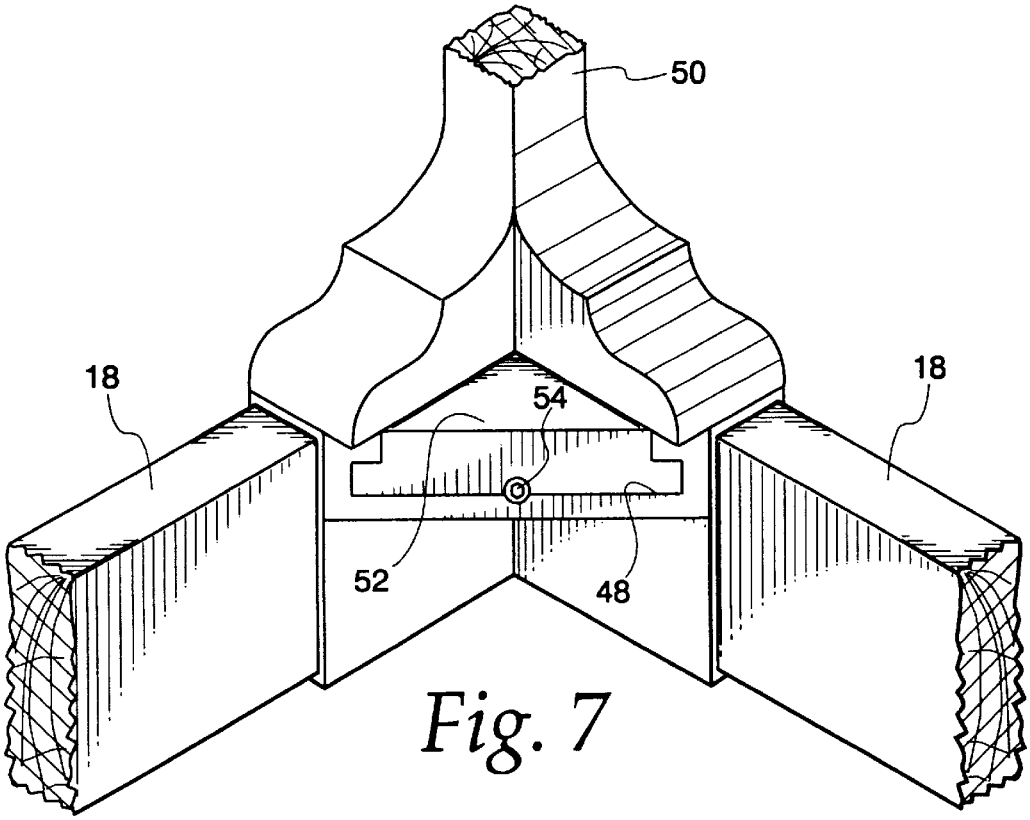
FIG. 7 is a view similar to FIG. 6, but showing a leg engaged in the bracket, and with part of the leg being broken away to avoid unnecessary detail.

FIGS. 6 and 7 illustrate a system substantially identical to the system 10, except that instead of a bracket 16 which is secured to the frame 18, the bracket 42 illustrated in FIGS. 6 and 7 includes cavities 44 and 46 into which the frame 18 extends. The bracket 42 thus forms a part of the frame of the item of furniture, rather than simply a separate element attached to the frame 18.

The bracket 42 includes a socket 48 which is substantially identical to the socket 32, and which is therefore not described in greater detail. When installed, a leg 50 has a pedestal 52 which is installed into the socket 48, and is secured by a fastener 54 in precisely the same manner as depicted and described in relation to FIGS. 1 through 5.

Although, in both forms of the invention, a fastener is utilized to secure the leg to the furniture frame, it will be evident that other means of attachment can be employed, such as deformable or engageable elements that allow the parts to mate, but will not allow the parts to be separated. Also, although not shown in great detail in the drawing figures, the combination of the flanges and the channels allow the leg 12 to tightly seat against the bottom of the frame 18 as the leg is urged into position.

Also, as explained above, while it is preferred that the leg and its top pedestal are molded together, the leg can be formed of any material and the top pedestal then secured thereto. Finally, while the brackets are shown as separate elements which are secured in some manner to the frame 18, it will be evident that the brackets can be integrally molded with the frame 18, if possible. Various changes can be made to the invention without departing from the spirit thereof or scope of the following claims.

What is claimed is:

1. A system attaching a furniture leg to an item of furniture and adapted to comprise portions of the furniture leg and the item of furniture, the system comprising a. an attachment segment extending from a top portion of said furniture leg, said attachment segment having a peripheral flange lying in a plane extending at an inclination to horizontal when the item of furniture is assembled, said flange having a wedge-shaped attachment nose lying in said plane, b. bracket means including a socket associated with the item of furniture, said socket being shaped to receive said attachment segment and having a wedge-shaped channel shaped to accommodate said wedge-shaped attachment nose, and c. means for securing said attachment segment to said socket, said securing means extending in a direction generally parallel to said plane.

2. The system according to claim 1 in which said attachment segment extends from a pedestal secured to and extending above said leg.

3. The system according to claim 1 in which said flange includes parallel legs extending from said attachment nose.

4. The system according to claim 1 in which said socket is formed in a bracket shaped to be secured to the item of furniture.

5. The system according to claim 4 in which said bracket comprises part of means for assembling a portion of the item of furniture.

6. The system according to claim 5 in which said securing means comprises a first aperture through said top portion, a second aperture in said socket and in registration with said first aperture, and a screw threadedbly secured through said first aperture into said second aperture.

7. The system according to claim 4 in which said securing means comprises a first aperture through said top portion, a second aperture in said socket and in registration with said first aperture, and a screw threadedbly secured through said first aperture into said second aperture.

8. The system according to claim 7 in which said apertures are aligned with said wedge-shaped attachment nose.

9. The system according to claim 1 in which said leg is molded, and said attachment segment is an integral part of said leg.

* * * * *